US006032886A

United States Patent [19]

Drinkwater et al.

[11] Patent Number: 6,032,886

[45] Date of Patent: Mar. 7, 2000

[54] ADJUSTMENT FOR ROCK CRUSHER

[75] Inventors: Daniel C. Drinkwater, Cottage Grove; Roger M. Clark, Springfield; Gerald E. Parker, Eugene; David F. Peaks, Eugene; Gary Heeszel, Eugene; Randy Orre, Eugene, all of Oreg.

[73] Assignee: Johnson Crushers International, Eugene, Oreg.

[21] Appl. No.: 09/271,507

[22] Filed: Mar. 18, 1999

[51] Int. Cl.[7] ..... B02C 2/04

[52] U.S. Cl. ..... 241/37; 241/207; 241/286

[58] Field of Search ..... 241/37, 207, 286, 241/208, 214, 215

[56] References Cited

U.S. PATENT DOCUMENTS 3,396,916 8/1968 Kemnitz .
4,289,280 9/1981 Mitrofanov et al. ..... 241/207
4,351,490 9/1982 Johnson .
4,463,908 8/1984 Ivanov et al. ..... 241/207
4,571,112 2/1986 Johnson .
4,615,491 10/1986 Batch .
4,666,092 5/1987 Bremer .
4,821,970 4/1989 Puetz .
5,718,390 2/1998 Ganser .

*Primary Examiner*—John M. Husar
*Attorney, Agent, or Firm*—Robert L. Harrington

[57] ABSTRACT

An adjustment mechanism for a rock crusher has an insert installed in the thread form of a bowl support and a locking ring. A bowl is threadably installed in the bowl support and lock ring assembly and is movable toward and away from a cone assembly. The insert is of a material that differs from that of the bowl and bowl support. The lock ring is movable to frictionally lock the thread forms of the bowl and bowl support against each other. The inserts prevent the galling and deformation of the thread forms previously experienced.

11 Claims, 4 Drawing Sheets

ADJUSTMENT FOR ROCK CRUSHER

FIELD OF THE INVENTION

This invention relates to a cone-type rock crusher wherein a crushing cone gyrates inside a bowl and crushes rock fed between spaced apart mated surfaces of the bowl and cone, and more particularly it relates to the mechanism for adjusting the spacing between the cone and bowl.

BACKGROUND OF THE INVENTION

A cone-type rock crusher crushes large sized rock retrieved from a rock quarry into small sized rock used for road beds and the like. The demand for the small sized rock varies between, e.g., one inch diameter rock, one-half inch diameter rock, etc., depending on the application. The rock crusher is preferably adjustable to crush the rock into the different sizes and in any event, due to wearing of the liner that provides the mating surfaces between the bowl and cone, the size of rock produced at a particular setting will over time increase in size and accordingly the rock crusher needs to be adjustable to accommodate the wearing of the liner.

There are several different types of mechanisms used for achieving this adjustability. Basically the adjustment amounts to raising or lowering the bowl of the crusher relative to the cone. The bowl is mounted to a bowl support of the main frame of the crusher and adjustment is a matter of raising or lowering the bowl as mounted to the frame. One type of mounting provides for vertically positioned bolts that bolt the bowl to the frame. Shims are transferred to positions on the bolt above or below the bowl connection to lower or raise the bowl. Hydraulic cylinders are also used. The type of mounting contemplated for the present invention, however, uses screw threads.

The bowl is provided with screw threads on an exterior circumference, which engage screw threads provided on an interior circumference of the bowl support of the frame. The bowl is simply screwed down to the desired spacing over the cone and then locked in place. When adjustment is desired, the locking mechanism is released and the bowl is screwed up or down to the desired position and re-locked.

The screw-type adjustment is preferred in the respect that the bowl is thereby rotated and changes the position of the liner circumferentially. Whereas the cone liner rotates (slowly) during the crushing operation, the bowl liner is held fast during a crushing operation. Screw-type adjustments achieve rotational repositioning of the bowl liner and avoids undesired wearing in a particular location of the liner.

The challenge for such screw adjustment is to achieve and retain the ability to turn the bowl on its threads. The threads are necessarily of large pitch, e.g., 2 inches, and the mass of the bowl produces large compressive forces between the engaged thread surfaces. Experience has taught that relative movement between such surfaces produces galling of the surfaces and the heat generated from such movement can weld the surfaces together and thereby prevent further turning.

A further problem is the requirement that during the rock crushing operation the bowl must not be allowed to move on its threads. A lock ring is used to create binding of the threads and prevent turning, but the conventional cinching down of the lock ring (which simulates the well known lock nut) to produce such binding is not suitable for the forces involved in a rock crushing application. Heretofore the lock ring has incorporated a plurality of circumferentially placed hydraulic rams that generate the desired binding and locking of the screw threads. Such has not been found satisfactory and the present invention serves to provide an improved mechanism for achieving this binding action.

BRIEF SUMMARY OF THE INVENTION

Referring first to the problem of the screw threads being welded to prevent desired turning, reference is made to a proposed a solution disclosed in U.S. Pat. No. 4,571,112. This patent teaches the provision of grooves in a load bearing surface of the screw threads and low friction inserts set into the grooves but projected outwardly of the screw thread surface. The force of the opposing thread surface is therefore applied against the inserts and not the screw thread surface having the inserts. The inserts being a dissimilar material and having a low co-efficient of friction, facilitates turning of the bowl relative to the frame.

However, the load of the bowl is thereby concentrated on the surface areas of the inserts which is substantially less than the thread surface. The inserts rapidly wear and due to inherent limitations as to the extent that the inserts can project out of the surface of the screw threads, the projected portion of the inserts will rapidly wear away and allow the undesired face-to-face engagement between the screw threads. Also, because of the smaller engagement surface of the inserts abutting the opposing screw thread surface, the inserts can produce some galling of the opposing screw thread surface. Still further, replacement of the inserts often requires re-machining of the groove, a task difficult to achieve "in the field".

Applicant's solution is to essentially provide complete replacement of the screw threads of one of the bowl and frame with a low friction, dissimilar material referred to as a thread replacement or thread producing insert. In the preferred embodiment, the circumferential surface of the selected component is sized to be set back or clear of the screw threads of the non-selected component. Grooves are formed in the circumferential surface (which may resemble a screw thread and is here referred to as a screw thread form) and elongate thread producing inserts are placed in the grooves. The inserts project from the grooves and are configured to form the screw thread of the selected component. The entirety of the insert projected from the thread serves as the engagement surface for the opposite screw thread. The inserts are easier to assemble into the selected component and the wearability is increased many times over that of the prior art.

Additionally, the thread producing inserts are resilient and formed into curved springs that are oversized in radius if intended for the exterior component (bowl support) and undersized if intended for the interior component (bowl). Forcing the spring-like inserts into the grooves produces a spring force that induces seating of the inserts in the grooves. Movement of the inserts in the grooves is prevented by inserting lock pieces at the extreme upper and lower ends of the seated inserts (multiple inserts typically making up a complete screw thread). Replacement in the field can be readily achieved without re-machining the thread forms and thus far more easily than the strip inserts of the prior art.

A similar insert is preferably applied to the locking ring. Locking of the bowl to the bowl support (frame) as required for the crushing operation, is provided by an annular seal and piston. An annular cavity is provided on the under side of the ring and the annular seal and piston is fitted to the cavity. A space above the seal and piston and within the cavity provides an expansion chamber. Hydraulic fluid pumped into the chamber forces the piston, e.g, against the frame with the lock ring screwed onto the bowl to generate the desired binding force. The annular piston produces the desired force consistently around the entire circumference.

The invention and its application to the preferred embodiments will be more fully appreciated upon reference to the following detailed descriptions and drawings referred to therein.

DESCRIPTION OF THE PREFERRED EMBODIMENT

Figure 1:
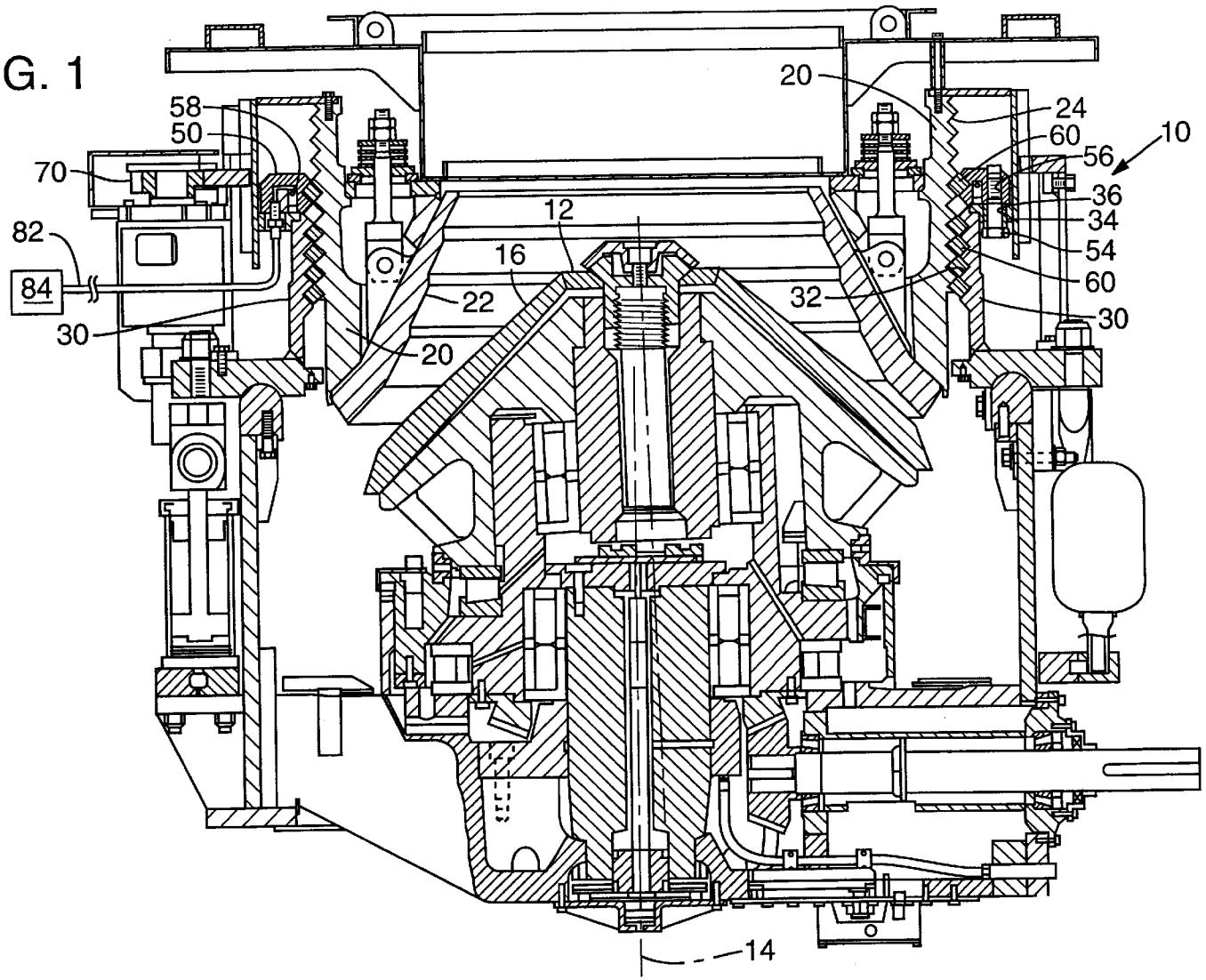
FIG. 1 is a view in cross section of a cone-type rock crusher.

FIG. 1 illustrates a portion of a cone-type rock crusher 10. The crusher 10 has a cone assembly 12 which rotates about a vertical axis 14 in an gyrating manner. A bowl 20 is adjustably mounted on the crusher 10 and is adjustable toward and away from the cone assembly 12. The bowl 12 is adjusted toward or away from the cone assembly 12 to adjust the closed side setting between the bowl 20 and the cone assembly 12. The cone assembly 12 has a replaceable liner 16 and the bowl 20 has a replaceable liner 22. During normal use, the liner 16 on the cone assembly 12 and the liner 22 on the bowl 20 are subject to wear during the crushing operation. As shown in the figure, the bowl 20 is adjustable upwardly and downwardly on a bowl support 30 which is part of the frame of the crusher 10. In this embodiment, the bowl 20 is threadably installed in the bowl support 30 and the bowl is adjusted toward and away from the cone assembly 12 by rotation of the bowl 20 relative to the bowl support 30. A lock ring 50 is provided to lock the bowl to the bowl support 30 when it is in the adjusted position.

Figure 2A:
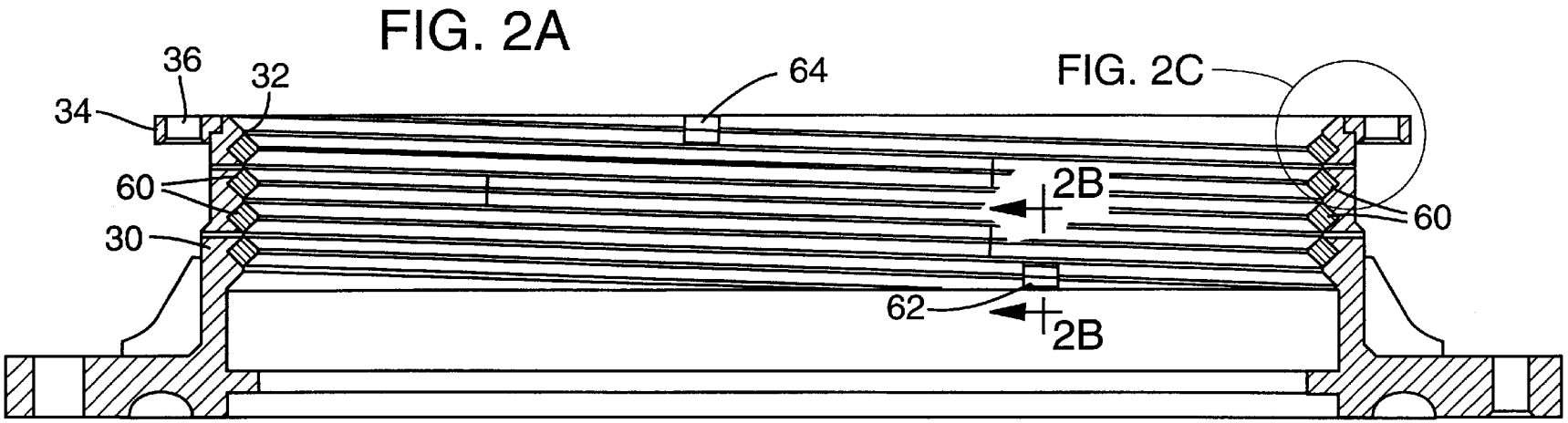
FIGS. 2A, 2B and 2C are views of a bowl support of the crusher of FIG. 1.
Figure 2C:
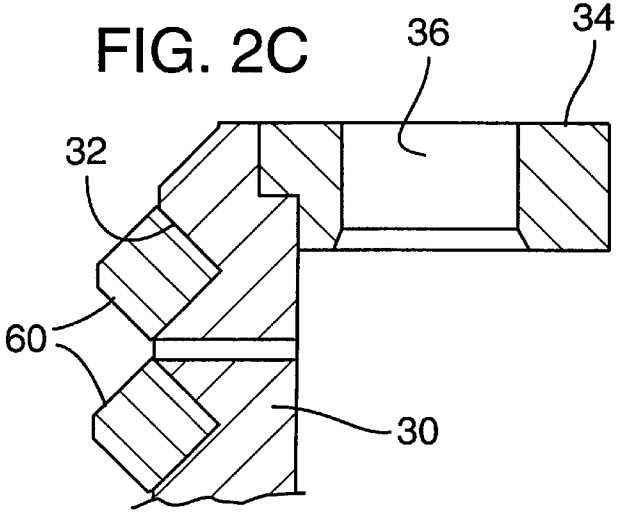
Figure 2B:
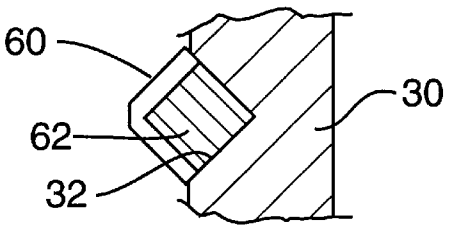

The bowl support 30 is fixedly mounted to the frame of the machine and as shown in FIG. 1, the bowl support 30 is mounted strategic to the cone assembly 12. Referring to FIGS. 2A, 2B and 2C the bowl support 30 has internal thread forms 32 formed on its interior surface. The bowl support 30 has a radially extending rim 34 for supporting a locking ring 50 (See FIG. 1). The rim 34 has bores 36 to receive guide pins that prevent the locking ring 50 from rotating relative to the bowl support 30.

Figure 3:
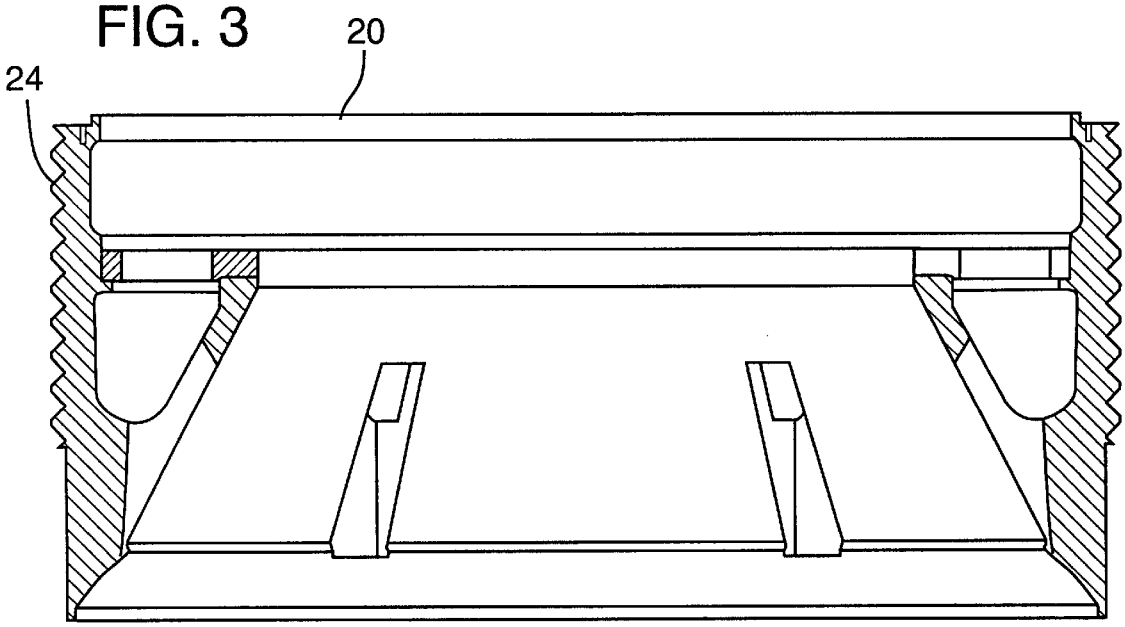
FIG. 3 is a view of a bowl of the crusher of FIG. 1.

The bowl 20 as seen in FIG. 1 is sized to fit within the bowl support 30 and is adjustably movable upwardly and downwardly toward and away from the cone assembly 12. The bowl 20 (best seen in FIG. 3) has an external thread 24.

Figure 5:
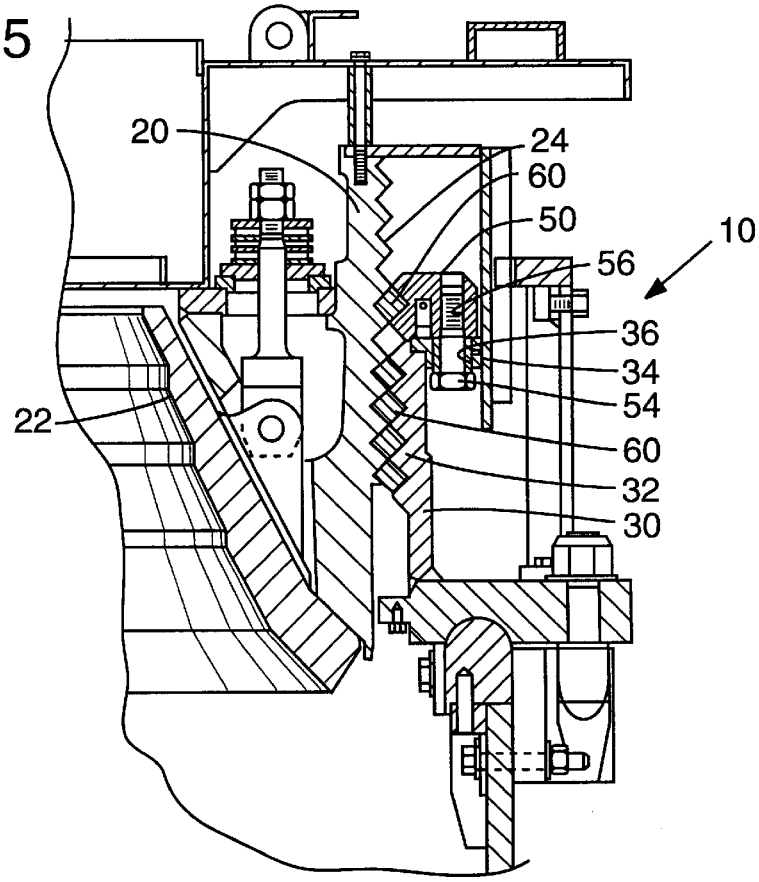
FIG. 5 is an enlarged partial view of the thread engagement between the bowl and bowl support as viewed in FIG. 1.
Figure 4A:
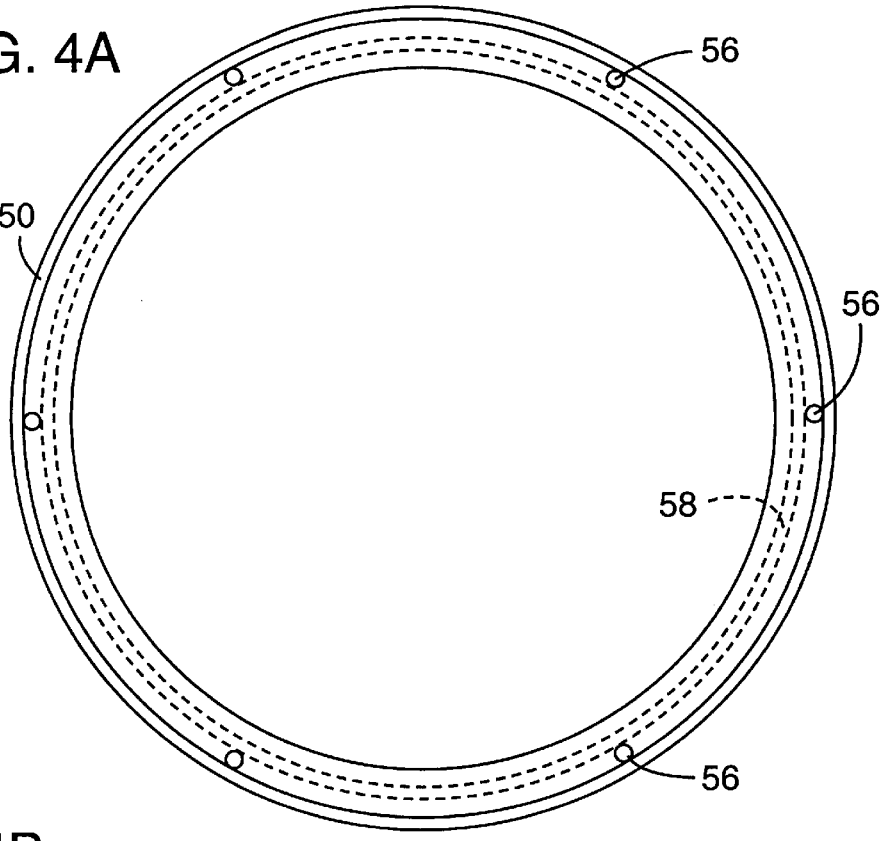
FIGS. 4A, 4B and 4C are views of a locking ring which locks the bowl to the bowl support.
Figure 4B:
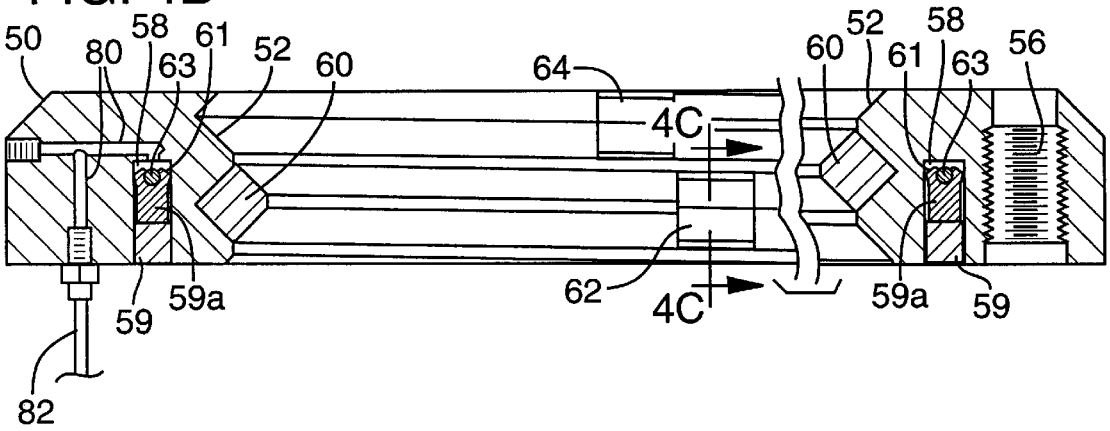
Figure 4C:
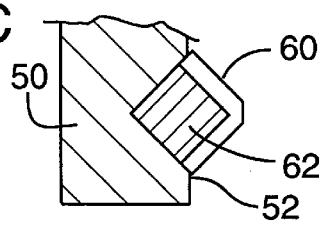

The lock ring 50 (FIGS. 4A, 4B and 4C) is circular in configuration and has internal thread forms 52 that are of the same configuration as the thread forms 32 of the bowl support 30. The lock ring 50 is mounted to the bowl support 30 as shown in FIGS. 1, 4B and 5 by pins 54 fitting through the bores 36 of the bowl support and threadably installed in a threaded bore 56 in the lock ring 50. The pins 54 prevent rotation of the lock ring 50 relative to the bowl support 30. The pins 54 are not tightened against the bowl support 30 and have a sufficient extension from the bowl support 30 to permit the lock ring 50 to be restrictively moved upwardly away from the bowl support 30.

The lock ring 50 has an annular groove 58 which serves as a cylinder. (See FIGS. 4A and 4B) An annular ring (piston) 59 is fitted to the annular groove 58 with the piston 59 being in abutment with the rim 34 of the bowl support when the lock ring 50 is installed on the bowl support (See FIGS. 2A and 2C). As seen in FIG. 4B, a seal portion 59*a* is separate from the piston but forms a complimentary part of the piston. Seal portion 59*a* has side flanges 61 and a central cavity receiving O-ring 63.

Ports 80 are provided in the lock ring (FIG. 4B) to supply hydraulic fluid to the cylinder 58. A hydraulic line 82 extends from the port 80 to a hydraulic source 84 (FIG. 1). Hydraulic fluid acting against seal portion 59*a* induces bulging of the flanges 61 to prevent fluid from getting past the seal portion and then downward movement of the seal portion 59*a* and the underlying piston 59.

Inserts 60 are installed in the thread form of the bowl support 30 and the lock ring 50 (FIGS. 2A and 4B). The inserts 60 in this embodiment are of a brass like resilient material which differs from the material of which the bowl support 30 and the lock ring 50 are made of. The inserts 60 are formed to conform to the thread form of the bowl support 30 and the lock ring 50. It is preferable to form the inserts 60 to a slightly larger diameter than the thread form of the bowl support 30 and the lock ring 50. The resilience of the inserts 60 when installed will force the seating of the inserts 60 in the thread form of the bowl support 30 and the lock ring 50.

A stop piece 62 is fixedly mounted in the thread form of the bowl support 30 as illustrated in FIG. 2B. The stop piece 62 is fixedly mounted to the thread form as by welding. The stop piece 62 will prevent the insert 60 from moving in the thread form 32.

In this embodiment multiple lengths of inserts 60 are installed in the thread form 32 of the bowl support 30. The lengths of the inserts 60 are generally of a length that is commercially available (i.e., 12 feet). The first insert 60 is placed in the thread form 32 with an end of the insert being abutted against the stop piece 62. The inserts 60 being formed to have a slightly larger diameter than that of the thread form 32 will, due to its resilient spring action, be forced to seat in the thread form 32. The next insert 60 is installed with one end of the insert being in abutment with the end of the first insert. Additional inserts 60 are installed until all of the fully formed threads 32 are filled. When all of the inserts 60 are installed, the inserts are forcibly moved toward the stop piece 62 to insure that the inserts 60 are fully abutted against an adjacent insert. Another stop piece 64 is abutted against the end of the last insert 60 and is fixedly attached to the thread form 32 as by welding.

Inserts 60 are fitted to the thread form 52 of the lock ring 50 (FIG. 4B) in the same manner as installed in the bowl support 30. Stop pieces 62 and 64 are fixedly mounted to the thread form 52 to secure the inserts 60 in position. It is preferable that the inserts 60 extend at least 360 degrees around the lock ring 50.

Refer again to FIGS. 1 and 5 of the drawings. The lock ring 50 is mounted to the bowl support 30 and is retained in position by pins 54. The bowl 20 is threadably installed to the assembly of the bowl support 30 and the lock ring 50. The thread form 24 of the bowl 20 will be engaged with the inserts 60 of the bowl support 30 and the lock ring 50.

A known drive mechanism, generally indicated by 70 in FIG. 1, rotates the bowl 20 relative to the bowl support 30

(and lock ring 50) to cause axial movement of the bowl 20. When the bowl 20 is rotated in one direction, the bowl 20 will be moved along axis 14 toward the cone assembly 12. When the bowl 20 is rotated in the opposite direction the bowl will be moved along axis 14 away from the cone assembly 12.

When the bowl 20 has been adjusted to be at the desired distance from the cone assembly 12, the bowl 20 is locked in position relative to the bowl support 30 by the lock ring 50. Hydraulic pressure is applied to the cylinder 58 which forces the seal portion 59*a* and thus piston 59 against the rim 34 of the bowl support. This forces the lock ring 50 upwardly away from the bowl support 30 which forces the insert 60 received in the thread form 52 upwardly against the thread form 24 of the bowl 20. This action "locks" (binds) the thread form 24 of the bowl 20 against the inserts 60 in the thread form 32 of the bowl support 30 and prevents rotation of the bowl 20 relative to the bowl support 30.

The insert 60 has been illustrated as being substantially square or diamond shape in section. It will be appreciated that other sectional forms such as circular, triangular and others may be utilized as an insert. The thread forms can also be differently configured as long as the inserts are correspondingly configured to fit the thread forms. Also it is contemplated that the inserts may be fixedly mounted to the thread form of the bowl instead of the bowl support. In this case, it may be desirable that the curve of the insert is undersized to provide the desired gripping. Other fastening methods may be employed to maintain the insert 60 in position such as adhesive bonding, threaded fasteners and the like. Another variation is to provide the chamber 58, seal portion 59*a* and piston 59 in the bowl support 30, e.g., in a modified version of rim 34 against which the lock ring is abutted.

Those skilled in the art will recognize that the modifications and variations may be made without departing from the true spirit and scope of the invention. The invention is therefore not to be limited to the embodiments described and illustrated but is to be determined from the appended claims.

What is claimed is:

1. A rock crusher comprising:

a conical shaped bowl, a cone mounted for oscillating movement within the conical shaped bowl, said bowl being vertically adjustable relative to the cone for crushing rock to specific sizes;

a frame including an annular bowl support, said bowl adjustably supported within said annular bowl support for vertical adjustment of the bowl relative to the cone;

said vertical adjustment provided by mated screw threads on said support and said bowl, the screw threads on one of the support and bowl provided by a recessed thread form that is spaced from and in non-engaging relation with the screw threads on the other of the support and bowl, and a thread producing insert seated in said thread form, said insert projecting from the thread form and into engagement with the screw threads of the other of said support and said bowl.

2. A rock crusher as defined in claim 1 wherein the insert is comprised of a elongated metal strip sized and configured to fit the configuration of the thread form, said insert being of a material that is dissimilar than the material of the bowl support and bowl.

3. A rock crusher defined in claim 2 wherein the insert is comprised of an elongated resilient metal member that is sized and configured to fit a thread form provided on the bowl, said thread form in natural state assuming a curved shape having a radius of curvature smaller than the thread form and which is resiliently forced onto the thread form to provide a grip-type seating of the insert in the thread form.

4. A rock crusher as defined in claim 1 wherein the insert is comprised of an elongated resilient member that is sized and configured to fit a thread form provided on the bowl support, said thread form in natural state assuming a curved shape having a radius of curvature greater than the thread form and which is resiliently forced into the thread form to provide a grip-type seating of the insert in the thread form.

5. A rock crusher as defined in claim 1 wherein the bowl and bowl support, within the region of the thread and thread form and without the insert seated in the thread form, are sized to provide free sliding of the bowl through the bowl support, the insert fitted to the thread form providing the screw-type relationship as between the bowl and bowl support.

6. A rock crusher as defined in claim 5 wherein the thread form has a similar configuration to that of the screw thread of the other of said support and bowl and the insert being diamond shaped to fit the screw thread and screw thread form.

7. A rock crusher as defined in claim 1 wherein the thread producing insert is configured along one side to mate with the thread form and provide removal and replacement without remachining of the thread form.

8. A rock crusher comprising:

a conical shaped bowl, a cone mounted for oscillating movement within the conical shaped bowl, said bowl being vertically adjustable relative to the cone for crushing rock to specific sizes;

a frame including an annular bowl support, said bowl adjustably supported within said annular bowl support for vertical adjustment of the bowl relative to the cone;

said vertical adjustment provided by mated screw threads on said support and said bowl whereby the bowl is screwed up or down on the support and thereby closer or farther away from said bowl;

an annular lock ring having a screw thread mated to the bowl and screwed onto the bowl and defining an annular surface in abutment with an annular surface of the support;

an annular chamber provided in one of the lock ring and bowl support and an annular piston fitted to the chamber, said piston providing the abutment surface for one of said lock ring and bowl support; and a hydraulic fluid source providing hydraulic fluid to the chamber, and a control for controlling the hydraulic fluid flow to the chamber for urging movement of the annular piston toward the surface of the other of the lock ring and support and thereby producing a binding-type lock that inhibits screw movement of the bowl.

9. A rock crusher as defined in claim 8 wherein the piston is provided with a seal portion between the piston and hydraulic fluid and expands under pressure to seal the chamber and induces movement of the piston against the other of the lock ring and bowl support.

10. A rock crusher as defined in claim 9 wherein the annular chamber is provided in the lock ring.

11. A rock crusher as defined in claim 8 wherein the screw threads on the support and the lock ring are provided by thread forms and inserts seated in said thread forms, said inserts projecting from the thread forms and providing the entire screw thread surfaces in mated engagement with the thread of the bowl.

* * * * *